US010472696B2

(12) United States Patent
Wagner et al.

(10) Patent No.: US 10,472,696 B2
(45) Date of Patent: Nov. 12, 2019

(54) METHOD FOR INTERCOOLING SHEET STEEL

(71) Applicant: voestalpine Stahl GmbH, Linz (AT)

(72) Inventors: Christoph Wagner, Eferding (AT); Siegfried Kolnberger, Pasching (AT)

(73) Assignee: voestalpine Stahl GmbH, Linz (AT)

( * ) Notice: Subject to any disclaimer, the term of this patent is extended or adjusted under 35 U.S.C. 154(b) by 211 days.

(21) Appl. No.: 15/516,462

(22) PCT Filed: Sep. 9, 2015

(86) PCT No.: PCT/EP2015/070607

§ 371 (c)(1),
(2) Date: Apr. 3, 2017

(87) PCT Pub. No.: WO2016/050465

PCT Pub. Date: Apr. 7, 2016

(65) Prior Publication Data

US 2018/0230568 A1 Aug. 16, 2018

(30) Foreign Application Priority Data

Oct. 2, 2014 (DE) ..... 10 2014 114 394

(51) Int. Cl.

| | |
|---|---|
| ***C21D 9/46*** | (2006.01) |
| ***C21D 1/667*** | (2006.01) |
| ***C21D 1/673*** | (2006.01) |

(52) U.S. Cl.

CPC ..... *C21D 9/46* (2013.01); *C21D 1/667* (2013.01); *C21D 1/673* (2013.01); *C21D 2211/001* (2013.01); *C21D 2221/00* (2013.01)

(58) Field of Classification Search

CPC .. C21D 1/667; C21D 1/673; C21D 2211/001; C21D 2221/00; C21D 9/46

See application file for complete search history.

(56) References Cited

U.S. PATENT DOCUMENTS

| | | | | |
|---|---|---|---|---|
| 2,400,931 A * | 5/1946 | Hume | C21D 8/0263 | 148/602 |
| 3,954,516 A | 5/1976 | Hu | | |
| 4,170,497 A * | 10/1979 | Thomas | C21D 1/25 | 148/333 |
| 5,989,647 A * | 11/1999 | Remy | F25D 3/10 | 118/302 |
| 2006/0121305 A1* | 6/2006 | Yoshikawa | C23C 2/26 | 428/629 |

(Continued)

FOREIGN PATENT DOCUMENTS

DE 102013100682 6/2014

*Primary Examiner* — Veronica F Faison

(57) ABSTRACT

A method for producing a hardened sheet steel, in particular a sheet steel that is coated with a metallic anti-corrosion layer; the sheet steel is first heated to an austenitization temperature and the austenite transformation is completed and then the sheet steel is pre-cooled to a temperature that lies above the transformation temperature of the austenite to other phases and is then transferred to a press-hardening die and in the press-hardening die, is shaped and, for hardening purposes, is quenched; for pre-cooling purposes, the blank is blasted in at least some areas or zones with dry ice, dry snow, or a gas flow containing dry ice particles.

9 Claims, 7 Drawing Sheets

(56) References Cited

U.S. PATENT DOCUMENTS

| | | | | |
|---|---|---|---|---|
| 2010/0156143 | A1* | 6/2010 | Gucker | B21D 5/06 296/187.03 |
| 2010/0282377 | A1* | 11/2010 | Evans | C21D 1/58 148/622 |
| 2012/0055592 | A1* | 3/2012 | Zurecki | C21D 1/667 148/578 |
| 2013/0180635 | A1* | 7/2013 | Okita | B21D 22/208 148/653 |
| 2014/0027026 | A1* | 1/2014 | Schwinghammer | C21D 1/673 148/650 |
| 2014/0246129 | A1* | 9/2014 | Amtmann | C21D 1/09 148/565 |
| 2014/0338802 | A1* | 11/2014 | Okita | B21D 22/208 148/653 |
| 2017/0314088 | A1* | 11/2017 | Wang | C21D 1/613 |

* cited by examiner

Welding Resistance

| | | Measured | | | | Ø |
|---|---|---|---|---|---|---|
| ZF1 | CO2 | 0,4 | 0,44 | 0,3 | | 0,4 |
| | ground | 0,8 | 1,6 | 0,9 | | 1,1 |
| | uncleaned | 1,5 | 1,6 | 4,8 | | 2,6 |
| | | | | | | |
| ZF2 | CO2 | 1,8 | 2,5 | 2,5 | | 2,3 |
| | ground | 1,8 | 1,9 | 1,5 | | 1,7 |
| | uncleaned | 18 | 21 | 5 | | 14,7 |
| | | | | | | |
| ZF3 | CO2 | 0,4 | 0,4 | 0,9 | | 0,6 |
| | ground | 0,7 | 0,7 | 1 | | 0,8 |
| | uncleaned | 175 | 90 | 170 | | 145,0 |
| | | | | | | |
| ZF4 | CO2 | 1 | 0,4 | 1,8 | | 1,1 |
| | ground | 5 | 6 | 7 | | 6,0 |
| | uncleaned | 10 | 7 | 6 | | 7,7 |
| | | | | | | |
| | | | | | | |
| Z1 | CO2 | 1,1 | 2 | 1,7 | | 1,6 |
| | ground | 1,6 | 2 | 1,5 | | 1,7 |
| | uncleaned | 140 | 190 | 200 | | 176,7 |
| | | | | | | |
| Z2 | CO2 | 1,1 | 1,7 | 1,6 | | 1,5 |
| | ground | 3 | 3,2 | 5,5 | | 3,9 |
| | uncleaned | 200 | 130 | 90 | | 140,0 |
| | | | | | | |
| Z3 | CO2 | 1,6 | 1,6 | 2,9 | | 2,0 |
| | ground | 1,3 | 3,2 | 3,6 | | 2,7 |
| | uncleaned | 140 | 65 | 36 | | 80,3 |
| | | | | | | |
| Z4 | CO2 | 0,3 | 0,6 | 1,2 | | 0,7 |
| | ground | 1 | 1,1 | 1,2 | | 1,1 |
| | uncleaned | 25 | 31 | 89 | 77 | 55,5 |

FIG. 5

METHOD FOR INTERCOOLING SHEET STEEL

FIELD OF THE INVENTION

The invention relates to a method for intercooling sheet steel and sheet steel components.

BACKGROUND OF THE INVENTION

It is known to produce hardened steel components out of steel sheets; for hardening purposes, these steel sheets are first heated to a temperature above the austenitization temperature in order to carry out a phase transformation to austenite within the steel structure. This austenitic structure is then transformed by quench-hardening into a martensitic structure, which ensures a high hardness of the steel component.

This method is particularly used for automotive parts; either the sheet steel component is preformed and the preformed sheet steel component is then austenitized and quench-hardened in a form-hardening die by applying a cold forming tool or else a flat blank is austenitized and after the austenitization, is shaped in a press-hardening die and simultaneously quench-hardened.

The form-hardening and the press-hardening both yield a hardened sheet steel component.

In recent years, it has become possible even for steel sheets that have already been provided with an anti-corrosion coating, i.e. sheet steel with a zinc-based or aluminum-based coating, to undergo such a shaping and hardening step.

In this connection, it has turned out that in the press-hardening method, i.e. when the shaping and quench-hardening are carried out simultaneously, cracks are often observed on the surface of components, which can be up to several 100 μm deep. These cracks are attributed to so-called liquid metal embrittlement, which means that liquid metal of the coating, i.e. zinc or aluminum, comes into contact with the austenite while the austenitic structure is subjected to mechanical stress. This is said to be the cause of the cracks.

In order to avoid this liquid metal embrittlement, the applicant knows to adjust the steel material in a transformation-delayed fashion in such a way that the transformation from austenite into martensite only occurs at temperatures that lie below the melting temperature of the metallic coating that is present at the time. Since even in transformation-delayed steels, the complete austenitization must be brought about first, this absolutely requires a heating to a temperature above the so-called $AC_3$ point. Before the shaping takes place with such steel materials, however, it is possible to wait until these steel materials have cooled to a temperature below the melting temperature of the coating metal or coating metal alloy in order to then perform the quench-hardening and shaping. This advantageously achieves the fact that at the moment in which the austenitic phases are subjected to mechanical stresses by the shaping, liquid metal is no longer present on the surface.

The applicant also knows that the blanks that are composed of the transformation-delayed steel material and have been coated with a metallic-based anti-corrosion coating can be cooled to a desired temperature below the fluid temperature of the coating metal by means of cooling plates, then removed from the cooling device, and then press-hardened.

Methods of this kind have in principle proven their value.

It is also known that zinc-based anti-corrosion coatings, due to the fact that they contain oxygen-affinity elements (elements that oxidize more quickly than zinc) form a superficial skin composed of oxides of the oxygen-affinity elements during austenitization. This oxide skin is glass-like and protects the zinc from oxidizing and vaporizing. In form-hardening or press-hardening, such superficial glass-like layers composed of the oxides of the oxygen-affinity element or elements are cleaned by means of various methods after the component has cooled to room temperature.

The object of the invention is to create a method for intercooling sheet steels and in particular austenitized sheet steel components, which yields an improved surface quality of the hardened component and an advantageously controllable intercooling.

SUMMARY OF THE INVENTION

According to the invention, it has been realized that with full-surface contact between the cooling plates and the accompanying compression forces during the pre-cooling, the sheets that are being subjected to the intercooling are cooled very rapidly. Due to this rapid cooling, the available process window for the entire cooling process—but also for the removal process and handing-off process—is very narrow.

In order to extend the process window, the inventors have used plates with poor thermal conductivity and have carried out the intercooling process using them. They were forced to conclude, though, that even plates with poor thermal conductivity dissipate the temperature of the blanks too quickly. Particularly with thin blanks, the heat is dissipated very quickly, thus complicating the task of reliable process control with regard to the clock cycle of presses.

According to the invention, the blanks that have been heated to the austenitization temperature, after they have exited the heating furnace, are transferred to a pre-cooling device in which they are dry ice blasted in either a prone or suspended position. The dry ice blasting can be used to very delicately regulate the intercooling without the cooling process occurring too rapidly, too intensely, or not intensely enough. This application is particularly advantageous with regard to the homogenization across the entire blank. Preferably in this case, the blasting strikes the blank from both broad sides, with the entire area or a partial area of the blank being blasted with dry ice by means of movable blasting devices. As defined by this application, "dry ice" can be $CO_2$, dry snow (frozen water), or similar media.

In one embodiment, the blasting can be carried out in such a way that across the blanks, different regions are intercooled with different intensities, thus making it possible to also produce so-called tailored property part (TPP) components in the subsequent shaping procedure.

In this connection, depending on a desired cooling speed or cooling intensity and/or depending on a desired temperature difference of different zones of the blank, the quantity of dry ice particles and/or dry snow particles and/or the dry ice particle density and/or the quantity of the carrier gas flow can be varied by zone.

According to the invention, not only does this achieve a very efficient, advantageously controllable pre-cooling, it also conditions the surface significantly better than with a dry ice cleaning that takes place at the end of the shaping process. This may possibly be due to the fact that this subjects the surface to such a powerful thermal load that it makes the glass-like uppermost oxide layer particularly easy to remove, with the zinc layer that is even more ductile at the beginning possibly also enabling an improved cleaning.

If the entire area of the blank is to be blasted, it is possible according to the invention to grip the blank, possibly at one end, introduce it into the pre-cooling device, blast it therein over the entire area on both sides with dry ice or similar media that ensure this thermo-shock effect, and after completion of the blasting and desired intercooling, to transfer it to the shaping device.

In this context, the blank can be introduced into the pre-cooling device and then a blasting over its entire area can take place. It is also possible, however, to provide dry ice blasting sources across the entire height of the hanging sheet steel blank in the pre-cooling device and to convey the sheet steel blank through this "dry ice curtain."

Alternatively, the stationary hanging blank can be blasted from top to bottom or from one side to the other by mobile dry ice blasting sources.

In another embodiment, the blank—lying on advancing rollers or traveling in sliding fashion on inclined guide rails—can also be conveyed through a pre-cooling device, with blasting devices arranged above and/or below the blank, and conveyed through the "dry ice curtain."

It is also possible to lay the blank on an intercooling table and to blast it with dry ice from above and below in such a way that the dry ice blasting from below is carried out so that the pressure is sufficient to levitate the blank and to ensure that the blasting is carried out in the gas cushion.

In this case, the dry ice particles and the dry ice particle density and thus the quantity of the carrier gas flow can be varied depending on the desired cooling speed.

With such an arrangement according to the invention, the cooling as a whole is delayed as compared to cooling plates. Sufficiently high cooling speeds are nevertheless ensured by means of convection.

The pre-cooling that can be achieved by means of this can be advantageously carried out in an extremely consistent fashion and can be controlled and regulated exceptionally well.

BRIEF DESCRIPTION OF THE DRAWINGS

The invention will be explained by way of example based on the drawings. In the drawings:

FIG. 5: is a table showing the welding resistances of four different galvannealed sheet steels and four different galvanized sheet steels in the uncleaned state, in the ground state, and in the warm dry ice-blasted state;

DETAILED DESCRIPTION OF THE PREFERRED EMBODIMENTS

According to the invention, a sheet steel blank is first heated to a temperature above the austenitization temperature in order to at least partially transform the steel into an austenitic structure. An austenitic structure can be transformed into a predominantly martensitic, hardened structure by means of quenching. Consequently, at least a part of the steel structure must be in the form of austenite in order to achieve this effect.

Particularly when using so-called transformation-delayed steel, i.e. a steel material in which the transformation from austenite into martensite takes place at relatively low temperatures, after the austenitization, the steel material can be intercooled to a temperature above the transformation temperature to martensite and only then is the quenching carried out.

With the austenitization of the steel material, an existing anti-corrosion layer on the sheet steel, which is essentially composed of metallic zinc with oxygen-affinity elements, forms a superficial skin composed of the oxide or oxides of the higher-oxygen-affinity elements. These higher-oxygen-affinity elements are, for example, aluminum, magnesium, boron, and the like, elements, which, when they are present in a zinc layer, under the influence of temperature and oxygen, diffuse to the surface of the zinc layer and are preferably oxidized there.

This oxide skin forms during the austenitization and is then present at room temperature in the form of a glassy top layer.

According to the invention, the pre-cooling is carried out in that the surface of the sheet steel blank and in particular, the surface of the sheet steel blank provided with the anti-corrosion layer, is blasted with dry ice or dry ice particles or a gas flow containing dry ice particles.

The blasting with dry ice produces a cooling of the sheet steel blank, it being possible to advantageously control the cooling very exactly and in a locally different and nevertheless particularly consistent way.

In addition, the dry ice blasting favorably cleanses the surface of the oxides of the higher-oxygen-affinity elements that are only required for the austenitization. This has in fact already been carried out at room temperature and is known, but there appears to be a synergistic effect between the intercooling with dry ice and the accompanying cleaning of the surface because the cleaning of the oxides at higher temperatures has turned out to be more effective.

This also means that after the hot-forming, the product is hardened and does not require any further surface conditioning. In particular, this saves one work step and thus reduces costs.

Figure 1:
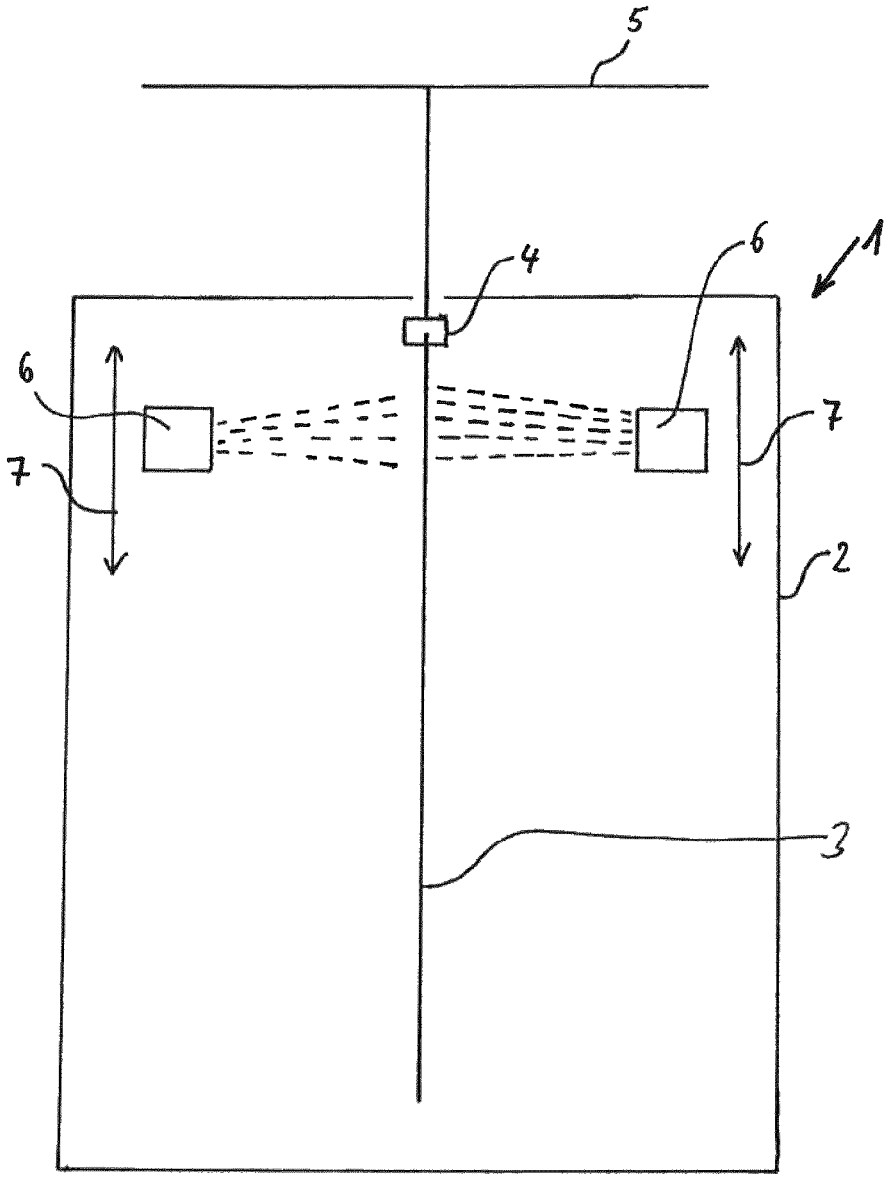
FIG. 1: shows a very schematic view of a first embodiment of an intercooling device with dry ice blasting.
Figure 2:
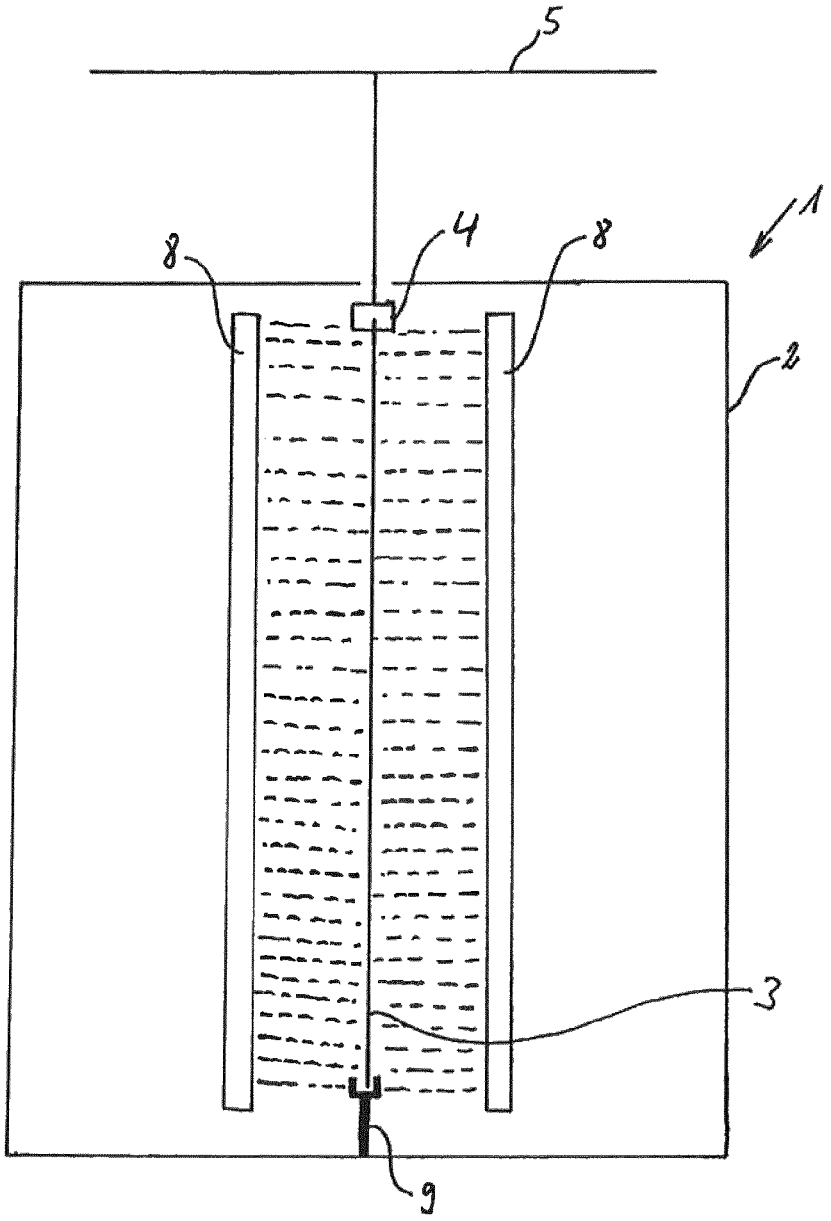
FIG. 2: shows the device according to FIG. 1 in another embodiment.
Figure 3:
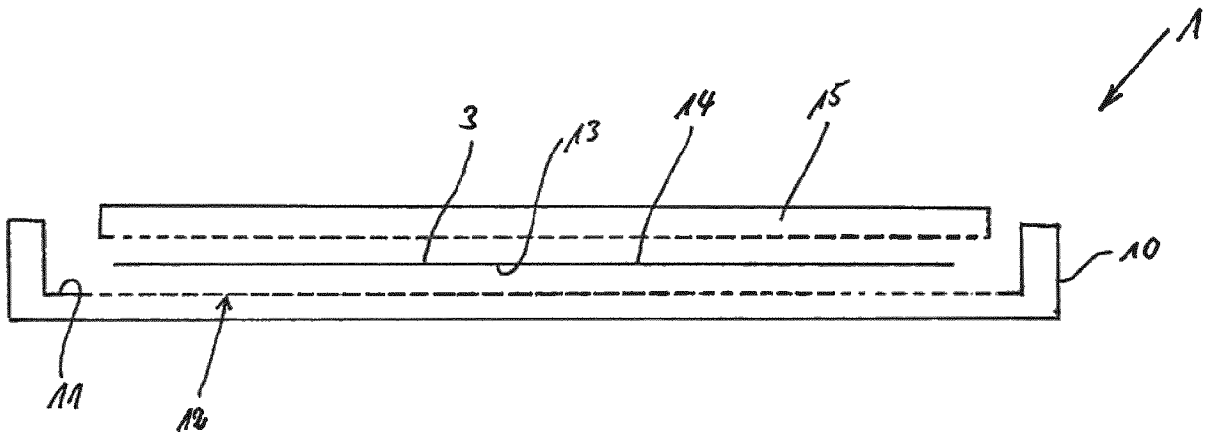
FIG. 3: shows another embodiment of a device for dry ice blasting.

For example, a device 1 for performing the method according to the invention (FIGS. 1 through 4) has a chamber 2 (FIGS. 1 and 2) into which a sheet steel blank 3 can be introduced or conveyed. In particular, the blank 3 is transported in suspended fashion, with the blank 3 being arranged in suspended fashion by means of a gripper or suspension mount 4 provided on a device 5 for conveying it into and out of the chamber 2. In the chamber, dry ice particle blasting devices 6 are provided, which can be moved from the region of a suspension mount 4 in an arrow direction 7 along the blank 3 and can thus successively and gradually blast the surface of the blank 3 from top to bottom.

The blasting devices 6 in this case can be arranged on rails (not shown) or other movement devices (not shown) so that they can be moved along the blank 3 and/or can be moved toward or away from the blank. In particular, it is conceivable for the blasting devices to be arranged on robotic arms.

In another advantageous embodiment (FIG. 2, parts that are the same have been provided with the same reference numerals), full-area blasting devices 8 are arranged on both sides of the blank in the chamber 2, which act on the entire area of the blank in a blasting fashion using dry ice or dry ice particles. To this end, the blasting devices 8 have corresponding openings from which can emerge dry ice, dry ice particles, or a gas flow containing dry ice particles.

In this case, however, the blasting devices 8 can also be embodied as strips 8 that extend across the height of the suspended blank and produce a dry ice particle curtain through which the blank 3 is conveyed with the aid of the moving device 5. In order to prevent the blank 3 from oscillating, a guide rail 9 can be provided at a longitudinal edge opposite from the suspension device 4, at the bottom of the chamber.

In another embodiment of the invention (FIG. 3), the device 1 is embodied with a table 10 or a flat trough 10, the trough 10 having a blank-side surface 11 and in the blank-side surface 11, nozzles or outlet openings 12 are provided for dry ice, dry ice particles, or a gas flow containing dry ice particles. A blank 3 can be placed onto this table 10 or into this trough 10, with the blank 3 being kept in a hovering state by the particle or gas flow by means of a gas cushion between the top surface 11 and a blank underside 13. The blank is placed onto the table 10 or into the flat trough 10 in particular by means of a conventional manipulator such as a robot. In order to achieve a uniform cooling and blasting of the blank 3, it is possible to act on the top surface 14 of the blank with a full-area blasting device 15 that is correspondingly embodied relative to the table or trough 10 and on the side facing toward the blank 3, is equipped with nozzles or openings for releasing dry ice, dry ice particles, or a gas flow containing dry ice particles. This device 15 can be embodied for raising and lowering in order to enable insertion and removal of the blank.

Instead of being embodied as a full-area blasting device 15, the device 15 can also be embodied in the form of a beam that is conveyed across the blank while the blank is kept in a hovering state by the gas cushion below.

In another advantageous embodiment (FIG. 4), the device 1 is once again embodied with a chamber 2, the chamber 2 being embodied as a through-type chamber with a chamber inlet 16 and a chamber outlet 17.

Inside the chamber 2, the blank 3 is moved in the advancing direction (arrow 19) on ceramic rollers 18, for example, with the blank being acted on from both the top side 14 and the bottom side 13 by means of a respective blasting device 20 that directs a dry ice jet, a dry ice particle jet, or a gas flow containing dry ice particles onto the surfaces of the blank.

Figure 4:
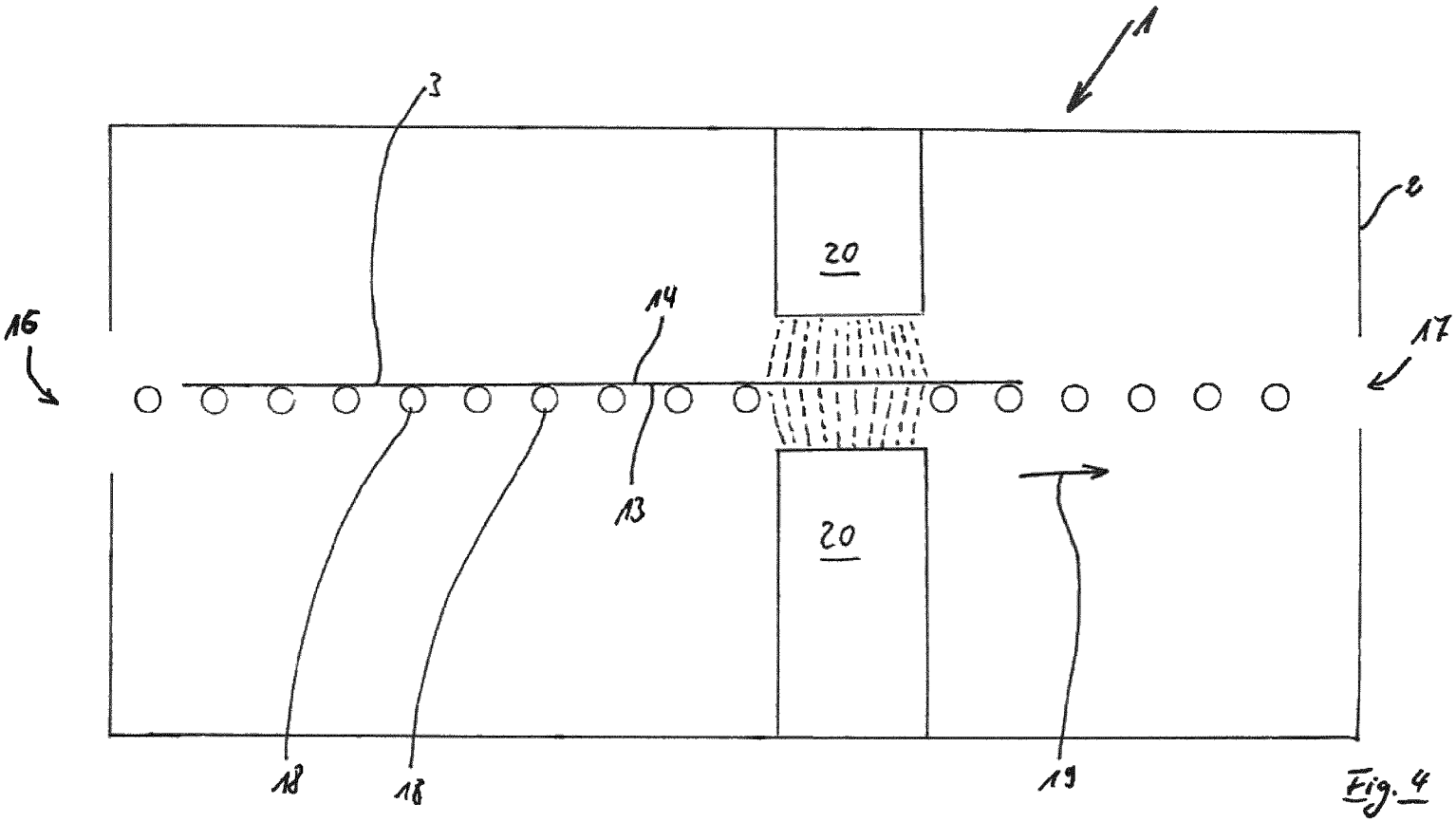
FIG. 4: shows another embodiment of a device for intercooling and dry ice blasting.

In this case, the blasting devices 20 can act on the entire area of the blank between the rollers 18 or (as shown in FIG. 4) in some areas of the blank surfaces as the blank passes through the device 1. The blank 3 passes through the chamber 2 and exits the chamber 2 through the outlet 17 in an intercooled and cleaned form and can then be transferred to a shaping and quenching tool.

Figure 6:
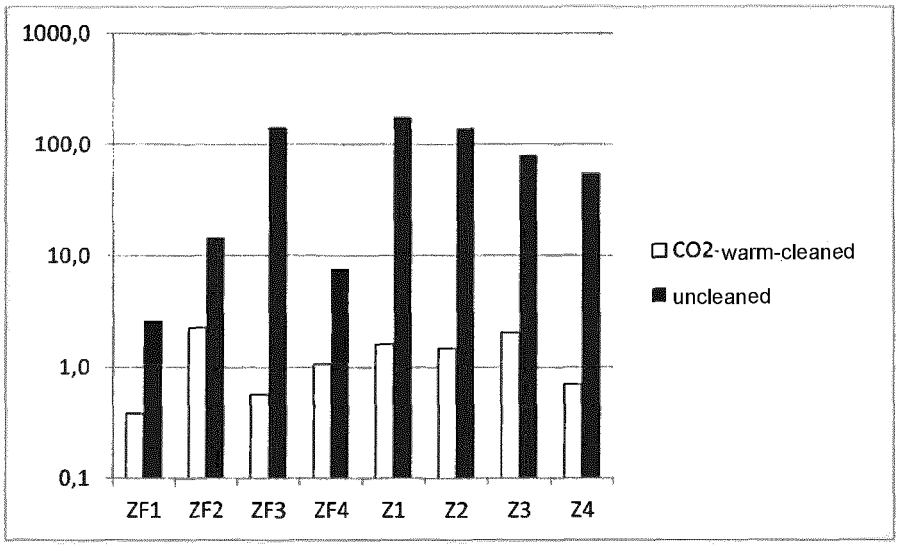
FIG. 6: is a chart showing the welding resistances of four different galvannealed sheet steels and four different galvanized sheet steels in the uncleaned state and in the warm dry ice-blasted state.

The table according to FIG. 5 and the chart according to FIG. 6 show the welding resistance in four different galvannealed sheet steels and four different galvanized sheet steels in three tests each, comparing the welding resistances of sheet steels dry ice-blasted in the warm state, sheet steels in the ground state, and sheet steels in the uncleaned state.

It is consistently clear that due to the dry ice blasting in the warm state, the welding resistances are significantly lower than with uncleaned sheets.

The welding resistance in galvannealed sheets is fundamentally lower than in galvanized sheets because the iron content in the zinc layer fundamentally improves the weldability.

Figure 7:
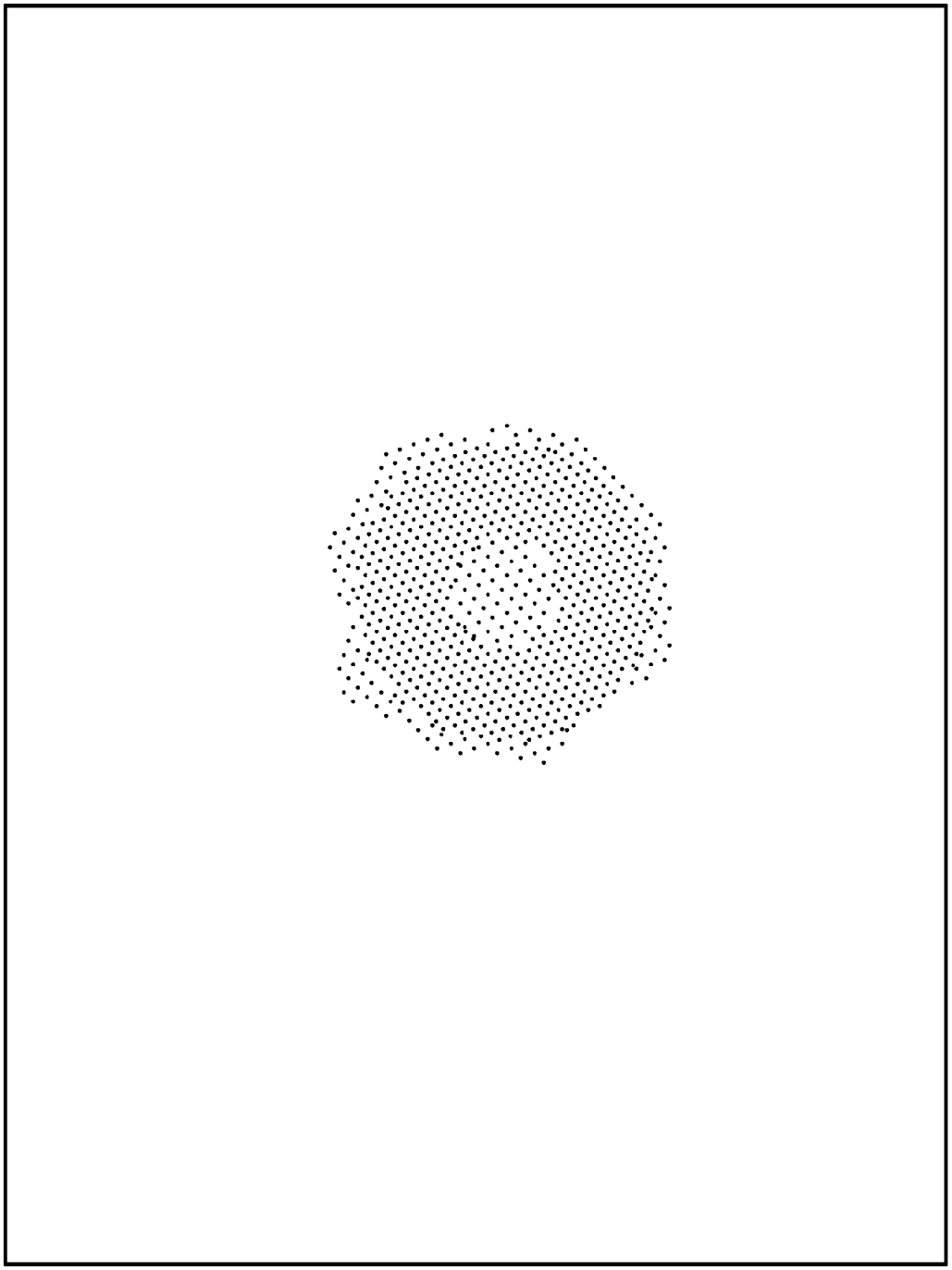
FIG. 7: is a photo showing the surface of a heat-treated sheet steel with a region that has been blasted with dry ice.

The particularly effective cleansing effect achieved by the dry ice blasting in the warm state is also evident in FIG. 7. A blank is shown therein, which has been blasted with dry ice only in some areas. By contrast with the otherwise greenish appearance of the blank, which is due to the presence of surface oxides, a region, namely the blasted region, is visible, which has a gray appearance, which is caused by the fact that the oxides have been cleansed from the zinc layer so that the metallic zinc is visible.

With the invention, it is advantageous that the intercooling of a sheet steel blank, in particular of a sheet steel blank with an anti-corrosion coating, is carried out in a simpler, more effective, and particularly favorably controllable manner, with a cleansing of the superficial oxides occurring at the same time. The method according to the invention can nevertheless also be successfully used with uncoated blanks; in this case, any scale that is present is removed even before the shaping tool, which—just as with coated blanks—leads to the positive effect in the shaping tool that the tool wear due to hard oxides is hindered or at least reduced.

In uncoated sheet steels, it is advantageous here that the dry ice blasting not only enables a very good intercooling, but also automatically produces a protective gas atmosphere in the temperature range from the departure from the austenitization furnace until the shaping takes place.

If heating has already occurred in a protective gas, then it is thus possible to maintain the protective gas atmosphere until the shaping takes place.

The invention claimed is:

1. A method for producing a hardened sheet steel that is coated with a metallic anti-corrosion layer, comprising:

first heating the sheet steel that is coated with a zinc-based anti-corrosion layer containing oxygen-affinity elements to an austenitization temperature and completing austenite transformation, wherein the austenitization causes a superficial skin composed of an oxide or oxides of higher-oxygen-affinity elements to form on the anti-corrosion layer;

pre-cooling the sheet steel to a temperature that lies above a transformation temperature of the austenite to other phases and simultaneously cleaning a surface of the sheet steel of oxides of the higher-oxygen-affinity elements, by blasting the sheet steel in at least some areas or zones with dry ice, dry snow, or a gas flow containing dry ice particles; and then transferring the sheet steel to a press-hardening die and shaping and, for hardening purposes, quenching the sheet steel in the press-hardening die.

2. The method according to claim 1, wherein for pre-cooling purposes and in order to produce zones with different mechanical properties, the sheet steel is acted on with dry ice, dry snow, or a gas flow containing dry ice particles, with a different intensity in different zones, with a different flow speed in different zones, with a different percentage of dry ice and/or dry snow in different zones, and/or with different temperatures and/or different cooling speeds in different zones.

3. The method according to claim 1, comprising varying the dry ice particles and/or dry snow particles and/or the dry ice particle density and/or the quantity of the carrier gas flow, depending on a desired cooling speed.

4. The method according to claim 1, comprising conveying the sheet steel into a pre-cooling device in a suspended fashion, blasting the sheet steel with the cooling medium over its entire area on both sides, and transferring the sheet steel to the shaping device after the blasting is completed.

5. The method according to claim 1, comprising introducing the sheet steel into a pre-cooling device and then blasting the sheet steel over its entire area.

6. The method according to claim 4, comprising introducing the sheet steel blank into the pre-cooling device in which the dry ice blasting devices are arranged over the entire height of the suspended sheet steel blank and conveying the sheet steel blank through this "dry ice curtain."

7. The method according to claim 1, comprising blasting a stationary suspended blank of sheet steel from top to bottom or from one side to the other by mobile dry ice blasting devices.

8. The method according to claim 1, comprising conveying a blank of the sheet steel, lying on advancing rollers or traveling in sliding fashion on inclined guide rails, through a pre-cooling device, with blasting devices arranged above and/or below the blank, and through a "dry ice curtain."

9. The method according to claim 1, comprising laying a blank of the sheet steel onto an intercooling table and blasting the blank with dry ice from above and below in such a way that the dry ice blasting from below is carried out so that the pressure is sufficient to levitate the blank and to ensure that the blasting is carried out in a gas cushion.

* * * * *